US005113914A

United States Patent [19]

Corain

[11] Patent Number: 5,113,914

[45] Date of Patent: May 19, 1992

[54] LEAF SPRING TYPE WEFT GRIPPING DEVICE IN A SHUTTLELESS LOOM

[75] Inventor: Luciano Corain, Vicenza, Italy

[73] Assignee: NUOVOPIGNONE-Industrie Meccaniche e Fonderia S.p.A., Florence, Italy

[21] Appl. No.: 642,204

[22] Filed: Jan. 15, 1991

[30] Foreign Application Priority Data

Jan. 26, 1990 [IT] Italy ..... 19161 A/90

[51] Int. Cl.[5] ..... D03D 47/20

[52] U.S. Cl. ..... 139/448

[58] Field of Search ..... 139/448

[56] References Cited

U.S. PATENT DOCUMENTS 3,532,136 10/1970 Golobart ..... 139/448
3,998,251 12/1976 Hadam ..... 139/448
4,417,606 11/1983 Corain ..... 139/448
5,007,463 4/1991 Corain et al. ..... 139/448

FOREIGN PATENT DOCUMENTS 2059455 4/1981 United Kingdom ..... 139/448

*Primary Examiner*—Andrew M. Falik
*Attorney, Agent, or Firm*—Morgan & Finnegan

[57] ABSTRACT

An weft yarn gripping device in a shuttleless loom in which the spring-loaded lever for pressing the gripping foot onto the relative rigid gripping surface cooperates with a travel stop block which absorbs part of the load exerted by said spring. The block is connected to the foot by a leaf spring rigid with the lever, and the leaf spring is inserted into a slot in a connection block which is rigid with said foot. Various mechanisms are also provided for varying the load transmitted to the gripping foot.

3 Claims, 2 Drawing Sheets

LEAF SPRING TYPE WEFT GRIPPING DEVICE IN A SHUTTLELESS LOOM

This invention relates to a new weft yarn gripping device which not only allows reliable and effective yarn gripping and retention in a shuttleless loom even with very weak yarns, but also allows gripping pressure adjustment and enables the gripping members to be easily and quickly opened for cleaning purposes.

BACKGROUND OF THE INVENTION

As is well known, the increasingly higher operating rates required of modern looms mean that the grippers for inserting the weft into the shed are required to undergo continually increasing simplification combined with increasing sophistication of their gripping devices which, ideally, should not only maintain a controlled loading along the entire gripping region but should also allow easy cleaning between the gripping members, which should therefore be able to be easily withdrawn from each other. Various types of weft yarn gripping devices for the grippers of shuttleless looms are already known in the current state of the art.

In one of these types a gripping foot, which can be rigid or flexible, is positioned above, but parallel to and in line with, a rigid gripping surface against which said foot is pressed by an overlying leaf spring.

Such a device, by providing perfect alignment between the foot and the relative gripping surface, enables the required load distribution to be obtained along the entire gripping region, but has the drawback of not allowing the foot to be cleaned as it cannot be raised.

To overcome this drawback another type of gripping device has been used in which said gripping foot is rigid with the end of a lever on which a spring acts to press the foot onto the underlying rigid gripping surface.

In this manner, on rotating the lever against the action of its spring, the foot is withdrawn from the gripping surface, making it possible to clean the inner gripping region. However, this new method produces misalignment between the mobile foot, which rotates about the lever pivot pin, and the gripping surface due to the inevitable constructional tolerances of the various components which, even if minimal, are always discernible.

To enable the mobile foot to perfectly adapt to the relative gripping surface to obtain the required load distribution along the entire gripping region, a thickness of elastic or elastomer material is now usually interposed between the foot and gripping surface and fixed to this latter, its purpose being to absorb said misalignment, but which is possible only if the foot has a certain rigidity and if the lever spring acts with a large force, this also enabling the negative effects of vibration to be also absorbed.

From the aforegoing it is apparent that such a gripping device not only has the drawback of a limited life in that the high spring load acting on the elastomer in the long term deforms the entire elastomeric gripping surface, but is also absolutely unsuitable for extremely weak yarns for which said load would be excessive, and in addition the much greater tapering of the foot required for weak yarns makes the foot very flexible, so that there is no longer a reliable control of the load pressing against the underlying elastomeric surface as said load varies along the gripping region, and the high flexibility of the foot means that it cannot be guaranteed to press uniformly against the elastomer along its entire contact length. The contact load is therefore uncertain as it is not adequately distributed over the entire gripping region.

DESCRIPTION OF THE INVENTION

The object of the present invention is precisely to overcome said drawbacks by providing a weft yarn gripping device in a shuttleless loom which is also effective for very weak yarns and in addition allows easy and fast adjustment of the gripping pressure and enables the gripping members to be opened for maintenance and/or cleaning purposes.

This is substantially attained in that the spring load acting on the lever, and which must necessarily be high to compensate the vibration of the mobile members, is made independent of the load transmitted to the gripping foot, which is done instead by a leaf spring with pressure adjustment, said gripping foot being kept resting always perfectly parallel to a underlying rigid gripping surface without elastomeric or elastic covering.

More specifically, the high load exerted by the spring on the lever is partially absorbed by a block acting as a lever travel stop, which thus limits the pressure applied to the gripping foot by a leaf spring mounted at the other end of the lever. In other words, the mobile gripping foot is no longer fixed to the lever but is disconnected from it and is kept pressed against the underlying rigid gripping surface, on which it rests perfectly so as to create the required pressure distribution over the entire contact region, by a leaf spring which, fixed to the free end of a spring-loaded lever the travel of which is limited by a travel stop block, transmits the residual load to said foot by being inserted into a slot in a connection block rigid with said foot. In this manner, as a result of the rotation of the lever against the action of its spring, the said connection between the leaf spring and the connection block causes a corresponding rotation of the gripping foot which results in its withdrawal from its gripping surface, so allowing easy maintenance and/or cleaning. Again, the constant perfect parallel alignment between the gripping foot and the gripping surface together with the fact that only a predetermined part of the load applied by the spring is transmitted to the foot makes this device particularly effective and reliable even with extremely weak yarns.

It is apparent that such a device also allows convenient adjustment of the pressure or load transmitted to the gripping foot by the leaf spring, this adjustment being achieved either by an adjustment screw acting between the leaf spring and the lever or by using leaf springs of different thicknesses and thus of different elasticity, or again by sliding said lever travel stop block to vary the arrangement or inclination of the lever and hence of the leaf spring.

Thus the weft yarn gripping device in a shuttleless loom, comprising a gripping foot cooperating with an underlying gripping surface positioned perfectly parallel to it and provided on the body of the device, said foot being pressed against said surface by the action of a spring-loaded lever, is characterized according to the invention in that one end of said lever cooperates with a travel stop block arranged to absorb part of the load exerted by said loading spring, the other end of said lever being connected to said gripping foot by a leaf spring which is fixed on said lever and is inserted into a slot in a connection block rigid with the foot, means also being provided to vary the load transmitted by said leaf spring to said gripping foot.

According to a preferred embodiment of the present invention, said means for varying the load transmitted by said leaf spring to said gripping foot consist of an adjustment screw acting between said leaf spring and said lever.

According to a further preferred embodiment of the present invention, said means for varying the load transmitted by said leaf spring to said gripping foot consist of the fact that said travel stop block cooperates with one end of said lever along an inclined plane and is adjustable in position by a screw thereon which cooperates with an elongate slot provided horizontally in the body of the device.

Finally, according to a further preferred embodiment of the present invention, said means for varying the load transmitted by said leaf spring to said gripping foot consist of an interchangeable series of different sized leaf springs to be screwed onto said other end of the lever.

DETAILED DESCRIPTION OF THE INVENTION

The invention is described hereinafter with reference to the accompanying drawings which illustrate a preferred embodiment thereof by way of non-limiting example in that technical and constructional modifications can be made thereto without leaving the scope of the present invention.

DETAILED DESCRIPTION OF THE DRAWINGS

Figure 1:
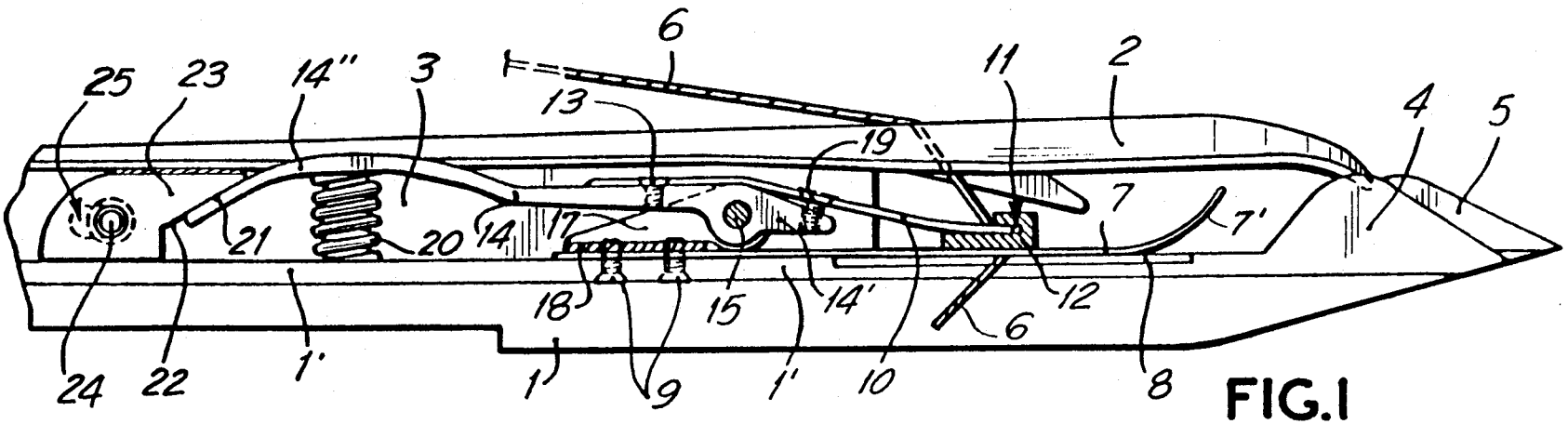
FIG. 1 is a partly sectional partial longitudinal view of a weft gripper using the weft yarn gripping device of the present invention.
Figure 2:
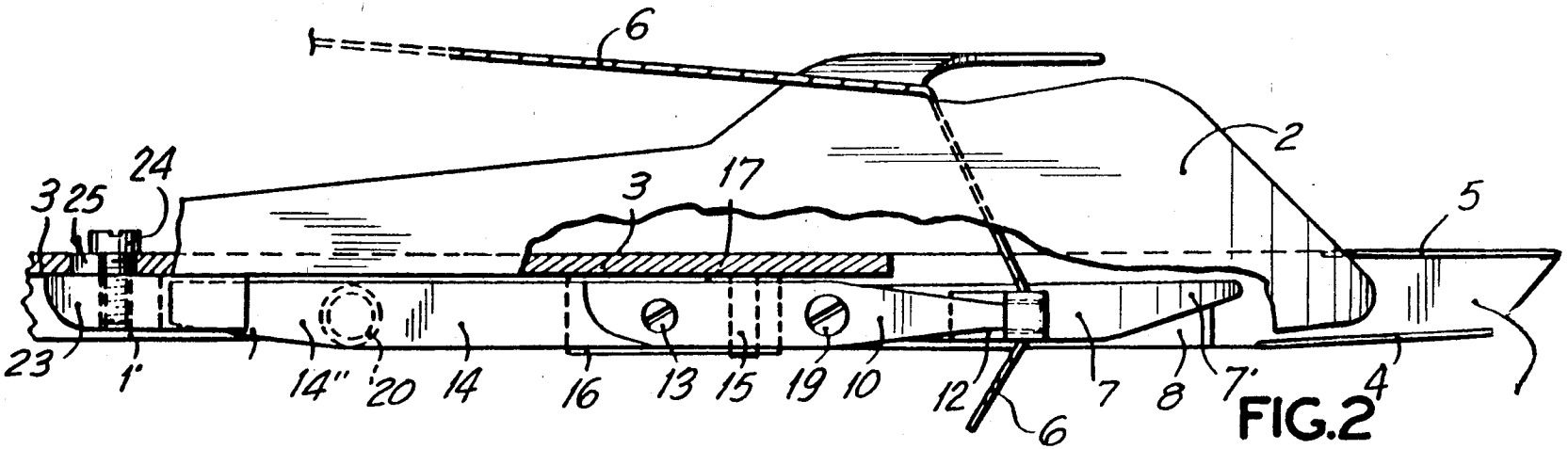
FIG. 2 is a partly sectional top view of the weft gripper of FIG. 1.

In the figures, the reference numeral 1 indicates the body of a weft gripper comprising a top protection cover 2 supported by the vertical wall 3 of the gripper and terminating at its front end in two vertical points 4 and 5 the purpose of which is to guide the weft 6 under the gripping foot 7 which for this purpose is curved upwards at its front end 7' to facilitate the insertion and retention of the weft 6 between said gripping foot 7 and the underlying rigid gripping surface 8 provided along the outer horizontal edge 1' of the body 1. Said gripping foot 7 is fixed by screws 9 to said edge 1' so as to extend perfectly parallel to the rigid horizontal gripping surface 8 and is kept elastically pressed against said surface 8 by the action of a leaf spring 10, one end of which is inserted into a slot 11 in a connection block 12 rigidly connected to the foot 7. The other end of said leaf spring 10 is fixed by the screw 13 to a lever 14 which is pivoted by the pin 15 between the two sides 16 and 17 of a support block 18 fixed to said edge 1' of the body 1 by the same screws 9 which fix said gripping foot 7. An adjustment screw 19 acting between the leaf spring 10 and the end 14' of the lever 14 enables the inflection of the leaf spring 10 and thus the load which it transmits to the gripping foot 7 to be varied. Said lever 14 is loaded by a robust spring 20 in the sense of urging the gripping foot 7 against the gripping surface 8 and has at its rear end an inclined surface 21 cooperating with a corresponding inclined surface 22 of a travel stop block 23 which, mounted on said edge 1' of the body 1, is fixed in an adjustable position by the screw 24 which passes through an elongate slot 25 provided horizontally in the vertical wall 3 of the body 1. In this manner a movement of the block 23 for example towards the left along the slot 25 causes an increased raising of the front part 14'' of the lever 14 to thus increase the load transmitted to the gripping foot 7, which consequently presses on the gripping surface 8 with greater pressure.

Figure 3:
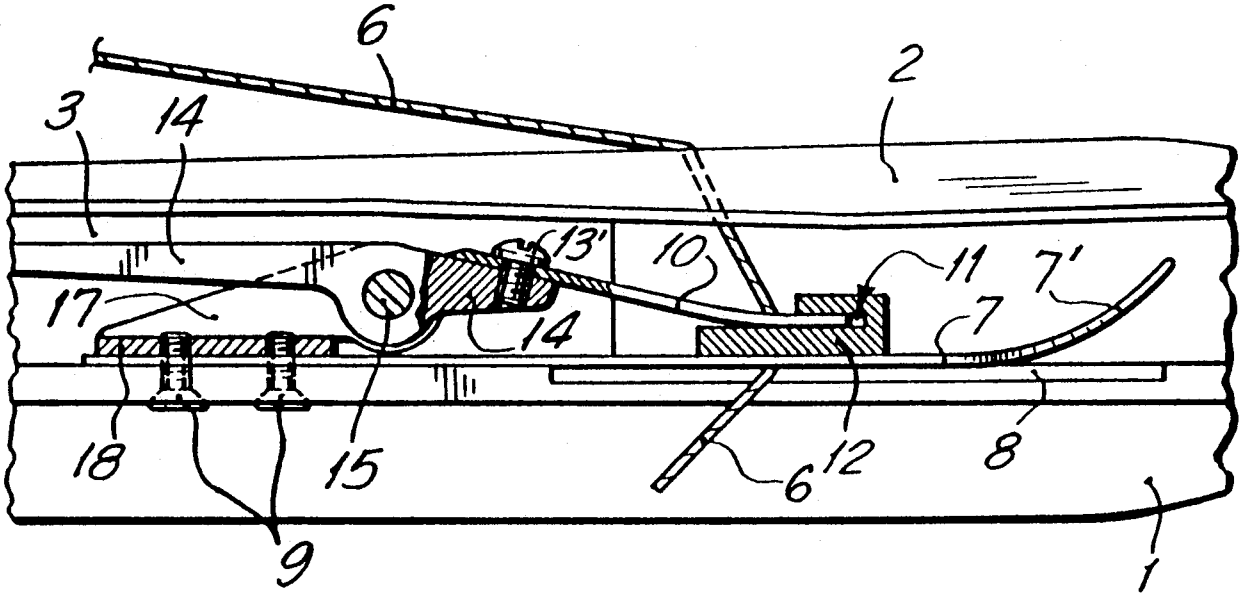
FIG. 3 is a partly sectional partial longitudinal view of a modification of the gripping device of the invention, to an enlarged scale.

However, the provision of said block 23 means that not all the load of the spring 20 is transmitted by the leaf spring 10 to the gripping foot 7, but only a determined part of it, the rest being absorbed by the block, which thus acts as a load divider. Finally, FIG. 3 shows a modification of the invention in which the leaf spring 10' is directly fixed onto the lever 14 by the screw 13' without an adjustment screw being provided. In this case the load adjustment is achieved by replacing said leaf spring 10' with another of a different size.

I claim:

1. A weft yarn gripping device in a shuttleless loom, comprising a body and a gripping foot cooperating with an underlying gripping surface positioned perfectly parallel to it and provided on the body of the device, said foot being pressed against said surface by the action of a spring-loaded lever, wherein one end of said lever cooperates with a travel stop block arranged to absorb part of a load exerted by said loading spring, an other end of said lever being connected to said gripping foot by a leaf spring which is fixed on said lever and is inserted into a slot of a connection block which is rigidly connected to the foot, and means to vary the load transmitted by said leaf spring to said gripping foot.

2. A gripping device as claimed in claim 1, wherein said means for varying the load transmitted by said leaf spring to said gripping foot comprise an adjustment screw acting between said leaf spring and said lever.

3. A gripping device as claimed in claim 1, wherein said travel stop block cooperates with one end of said lever along an inclined plane and is adjustable in position by a screw thereon which cooperates with an elongate slot provided horizontally in the body of the device.

* * * * *